United States Patent [19]

Bezdek

[11] Patent Number: 4,887,315

[45] Date of Patent: Dec. 19, 1989

[54] FOOD SPILL CATCHING AND SERVING DEVICE

[76] Inventor: William J. Bezdek, 2861 Hagadorn Rd., Mason, Michigan 48854

[21] Appl. No.: 325,528

[22] Filed: Mar. 20, 1989

[51] Int. Cl.[4] ..... A41B 13/10; A41D 13/04

[52] U.S. Cl. ..... 2/49 A; 2/49 R

[58] Field of Search ..... 2/48, 49 R, 49 A, 50, 2/51, 52

[56] References Cited

U.S. PATENT DOCUMENTS

| | | | |
|---|---|---|---|
| 114,366 | 5/1871 | Thomson | 2/49 |
| D. 232,276 | 8/1974 | Anderson | D2/2 |
| D. 238,117 | 12/1975 | Anderson | D2/2 |
| D. 238,521 | 1/1976 | Anderson | D2/2 |
| D. 288,260 | 2/1987 | Anderson et al. | D2/229 |
| 453,490 | 6/1891 | Kropp | 2/49 R |
| 497,340 | 4/1893 | Pollitt | 2/49 |
| 1,506,332 | 8/1924 | Bloom . | |
| 2,265,690 | 12/1941 | Fiedler | 2/49 |
| 2,367,383 | 1/1945 | Tiscornia | 2/49 R |
| 2,469,835 | 5/1949 | McMartin | 2/49 R |
| 2,672,614 | 3/1954 | Zimmerman et al. | 2/49 R |
| 2,688,750 | 9/1954 | Mink | 2/49 R |
| 3,032,773 | 5/1962 | Piazze | 2/49 |
| 3,945,048 | 3/1976 | Shearer | 2/49 R |
| 4,114,199 | 9/1978 | Malan | 2/49 A |
| 4,233,688 | 11/1980 | Hjerl | 2/49 R |
| 4,649,572 | 3/1987 | Roessler | 2/49 R |
| 4,660,226 | 4/1987 | Quilling et al. | 2/49 R |
| 4,793,004 | 12/1988 | Long et al. | 2/49 R |

*Primary Examiner*—Werner H. Schroeder
*Assistant Examiner*—Jeanette E. Chapman
*Attorney, Agent, or Firm*—Ian C. McLeod

[57] ABSTRACT

A device (10) for catching spills when foods are eaten in a moving vehicle is described. The device includes a tray (11) and a strap or straps (12*a* or 12*b*) which hold the tray in position across the chest (C) of the person (P). Preferably the tray is used by a driver of the vehicle. The device 10 can be cut from a sheet (20) of material to provide a preform (20*a*, 20*b*, 20*c* or 20*d*) which is assembled to form the device. The device can also be stacked (10A to 10F) with each of the straps inside each of the trays prior to use.

15 Claims, 3 Drawing Sheets

FOOD SPILL CATCHING AND SERVING DEVICE

BACKGROUND OF THE INVENTION (1) Field of the Invention

The present invention relates to a food spill catching device which is worn by a person in a moving vehicle, particularly a driver of the vehicle, to catch the spills. The device can also function as a serving tray for the food, usually a fast food. In particular the present invention relates to a spill catching device which can be assembled by a person dispensing the food from pre-cut preforms on a sheet of material or which can be pre-assembled at a factory and shipped in stacks.

(2) Prior Art

The prior art has described many different types of bibs. Illustrative are U.S. Pat. Nos. 114,366 to Thomson; 453,490 to Kropp; 497,340 to Pollitt; 1,506,332 to Bloom; 3,032,773 to Piazze; 2,265,690 to Fiedler; 2,672,614 to Zimmerman et al; 2,469,835 to McMartin; 3,945,048 to Shearer; 4,114,199 to Malan; 4,649,572 to Roessler; and 4,660,226 to Quilling et al. Design U.S. Pat. Nos. 232,276, 238,117 and 238,521 to Andersson and 288,260 to Anderson et al also show bibs.

A common characteristic of the prior art bibs is that they extend down the chest and stomach area of the user, usually an infant, to a pouch across the lap. The problem is that in a moving vehicle where there are usually bumps and ruts in the road, the food spills have too long a distance to travel and end up missing the bib and pouch. Further, in the case of a driver of the vehicle, necessary movements, such as turning the head, change the position of the mouth relative to the bib and prevent the bib from being effective. Further still, a bib is cumbersome to use while driving.

There is a great need for a device which will catch food spills particularly when a person is driving a vehicle. This is particularly true of traveling business people who can be wearing expensive clothing and who want to eat and drive a vehicle at the same time. It is very common experience to have a hamburger or other fast food spill on the clothing while it is being eaten by the person driving the vehicle. This results in expensive drycleaning bills. There is thus a need for an inexpensive, disposable device which will collect such spills. Further still, there is a need for a device which will also function as a food serving tray.

OBJECTS

It is therefore an object of the present invention to provide a device which will catch the food spills, particularly of the driver of a vehicle, and which can also serve as a tray for the food when it is sold. Further, it is an object of the present invention to provide an inexpensive, preferably disposable, device for catching the spills. Further still, it is an object of the present invention to provide a preformed and precut sheet of multiple preforms for the device which can easily be assembled when the fast food is dispensed. Alternatively, it is an object of the present invention to provide a device which is provided in stacks which are pre-assembled at a factory. These and other objects will become increasingly apparent by reference to the following description and the drawings.

In the Drawings

FIG. 1 is a front perspective view of the device 10 mounted on a person who can be driving a vehicle, particularly showing a tray 11 resting on the chest area with straps 12 around the neck of the person.

FIG. 2 is a front perspective view of the device with an end portion 11*d* which is to be assembled as shown by the arrows.

FIG. 3 is a plan view of a sheet 20 of material showing multiple preforms 20*a* to 20*d* which can be removed and folded on creases or perforations 21 to form the device 10.

FIG. 4 is a plan view showing the device 10 shown in FIG. 1 with the straps 12*a* and 12*b* folded into the tray 11.

GENERAL DESCRIPTION

Figure 1:
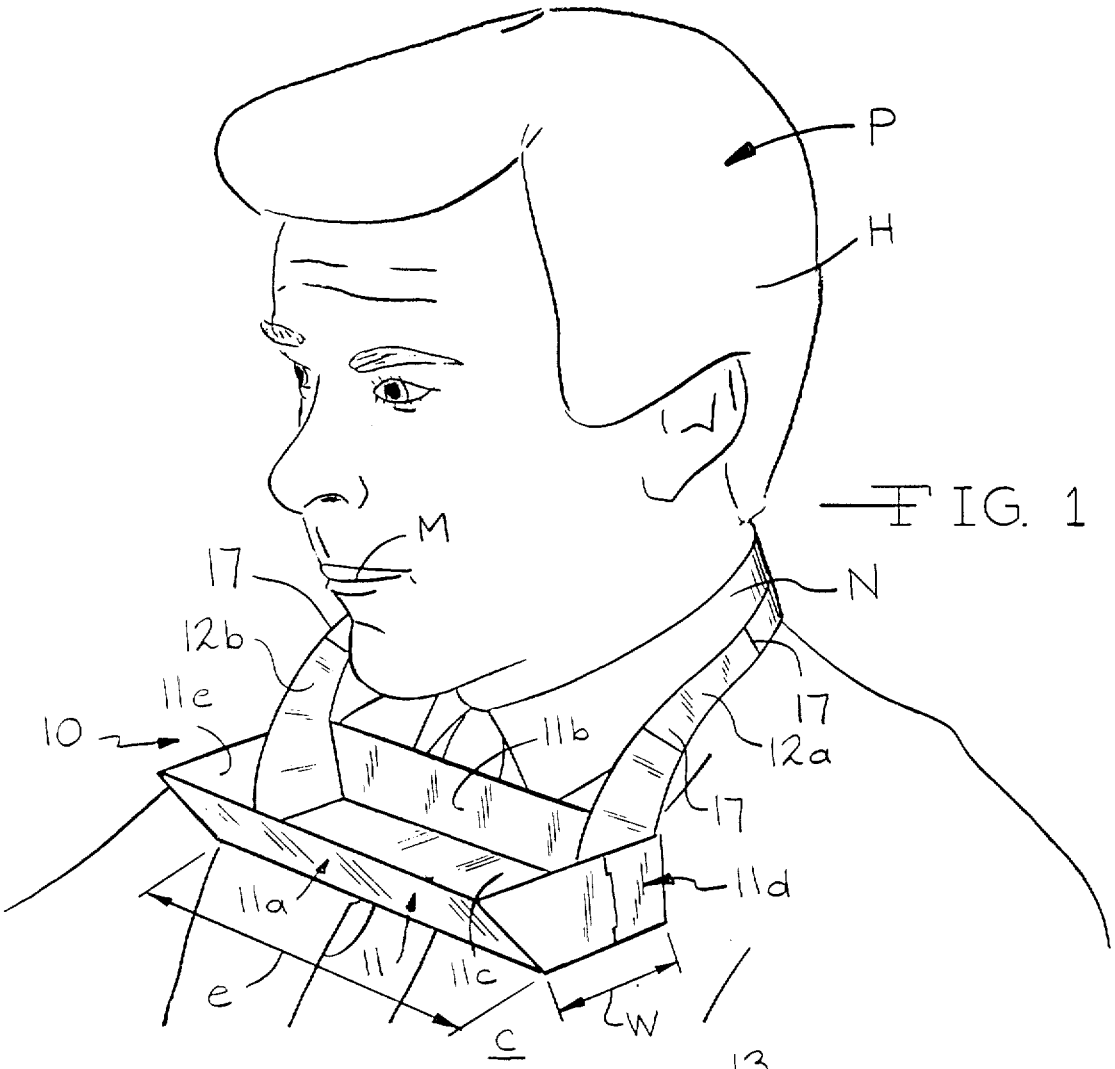

The present invention relates to a protective device for collecting food spills to be positioned on a front body portion of a person in an upper chest area to catch the spills from the mouth of the person while seated in a moving vehicle which comprises: a rigid tray having a bottom, a front side away from the body portion, a back side adjacent to the upper chest area and opposite ends connecting the sides and the bottom to form the tray with a recess for catching the spills; and a strap means provided at the ends of the tray which extend and fasten around the neck of the person, wherein in use food falls from the mouth by gravity into the recess in the tray while the person is seated in the moving vehicle.

The present invention also relates to a method for collecting food spills while seated in a moving vehicle which comprises: providing a protective device to be positioned on a front body portion of a person in an upper chest area which comprises a rigid tray having a bottom, a front side away from the body portion, a back side adjacent the upper chest area and opposite ends connecting the sides and the bottom to form the tray with a recess for catching the spills and a strap means provided on the tray which extend and fasten around the neck of the person, wherein in use food falls by gravity from the mouth into the tray while the person is seated in the moving vehicle; mounting the device around the neck using the strap means; collecting the food spills in the recess in the tray; and removing the strap means from around the neck after use.

Finally the present invention relates to a sheet of material containing multiple precut preforms which can be removed and assembled to form a protective device for collecting food spills to be positioned on a front body portion of a person on an upper chest area to catch the spills from the mouth of the person while seated in a moving vehicle which comprises: a rigid tray having a bottom, a front side away from the body portion, a back side adjacent to the upper chest area and opposite ends connecting the sides and the bottom to form the tray with a recess; and strap means provided on the tray which extend and fasten around the neck of the person, wherein in use food falls by gravity from the mouth into the tray while the person is seated in the moving vehicle, wherein the tray and strap means for each device are provided by the sheet of material.

The preforms for the device are usually constructed of thin cardboard or plastic material (0.0254 to 0.1270 cm or 0.01 to 0.05 inch thick) which is disposable. The preform can have creases or perforations which allow folding for assembly. The tray of the device is rigid. The straps can be flexible or rigid so long as they are foldable into the tray.

The device can be assembled at a factory and stacked or it can be assembled when the food is dispensed. The device could also be molded at a factory so that it would not have to be assembled.

Various attachment means can be used to secure the straps around the neck of the user and for fabrication of the preforms, such as hook and loop type fasteners, clips, ties and the like (not shown). Interlocking tabs and openings on separate portions of the straps and on the ends of the tray can be used. Such fastening means are well known to those skilled in the art.

The device can also be used to dispense the food at a restaurant. It can also have a cover over the recess which can be removed prior to use of the tray. The cover can be like a conventional removable box cover for the tray means. The cover can be hinged by a crease along the upper edge of the front side of the tray in order to provide an additional spill catching recess.

SPECIFIC DESCRIPTION

As shown in FIG. 1, the preferred device 10 is provided on the person P with a tray 11 supported against to 15.24 cm) above a horizontal line between the nipples of the breast. The tray 11 is positioned so that it is directly below the mouth M regardless of the rotational position of the head H relative to the neck N. Straps 12*a* and 12*b* are mounted on the tray 11 and in use are positioned around the neck N of the person P.

The tray 11 has a front side 11*a* away from the chest C and a spaced apart rear side 11*b* which rests against the upper portion chest C. The sides 11*a* and 11*b* are connected by a bottom 11*c* and ends 11*d* and 11*e*. As can be seen from FIG. 1, the sides 11*a* and 11*b* and bottom 11*c* have a length (l) which is longer than the width (w) of the ends 11*d* and 11*e*. Preferably the ratio of (l) to (w) is between about 3 to 1 and 5 to 1. The width (w) of the tray is preferably no less than about 2 inches (5.08 cm). The result is a tray 11 which catches the spills when the driver's head, or the vehicle (not shown) moves. As can be seen, this construction provides for safety as well as cleanliness since the driver's vision is not diverted from the road while eating.

Figure 2:
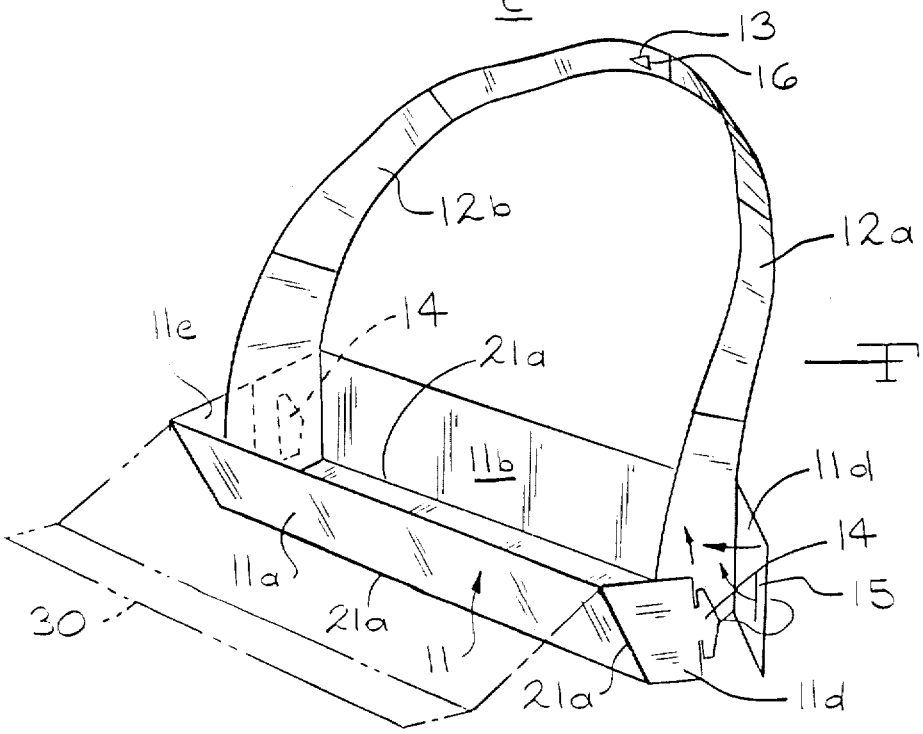
Figure 3:
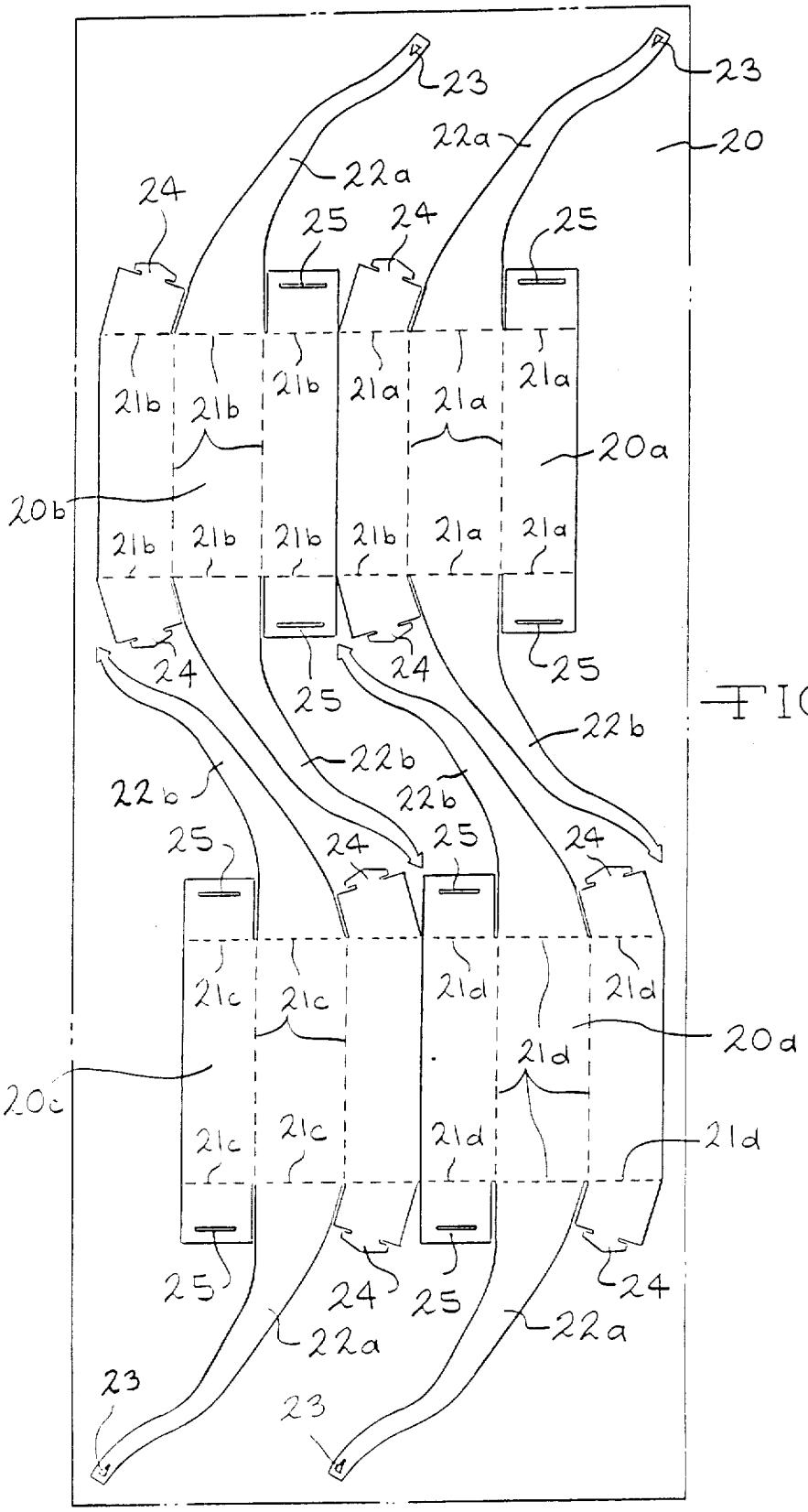

FIGS. 2 and 3 show the assembly of the device 10 Multiple preforms 20*a* to 20*d* are provided in a sheet 20 of material. The sheet 20 is preferably precut as shown by the solid lines of the preforms 20*a* to 20*d* so that the preforms 20*a* to 20*d* can be easily removed from the sheet 20. The preforms 20*a* to 20*d* are preferably provided with creases or perforations 21 as shown by the dotted lines so that the preforms 20*a* to 20*d* can be folded as shown in FIG. 2. Preforms 22*a* and 22*b* form straps 12*a* and 12*b*. Openings 23 are provided for tab 24 on preforms 22*a* and 22*b*. Preform tab 24 becomes tab 14 as shown in FIG. 2. Preform opening 25 becomes opening 15 on ends 11*d* and 11*e* as shown in FIG. 2. Preform opening 23 becomes opening 16 on the strap 12*b*. Multiple openings (not shown) can be provided in place of single opening 13 to accommodate different sized persons.

As shown in FIG. 2, a cover 30 can be hinged on the front side 11*a* of the tray 11 so as to fold over and cover the tray 11. The tray 11 can also have handles at the ends (not shown) for carrying the food in the tray 11.

Figure 4:
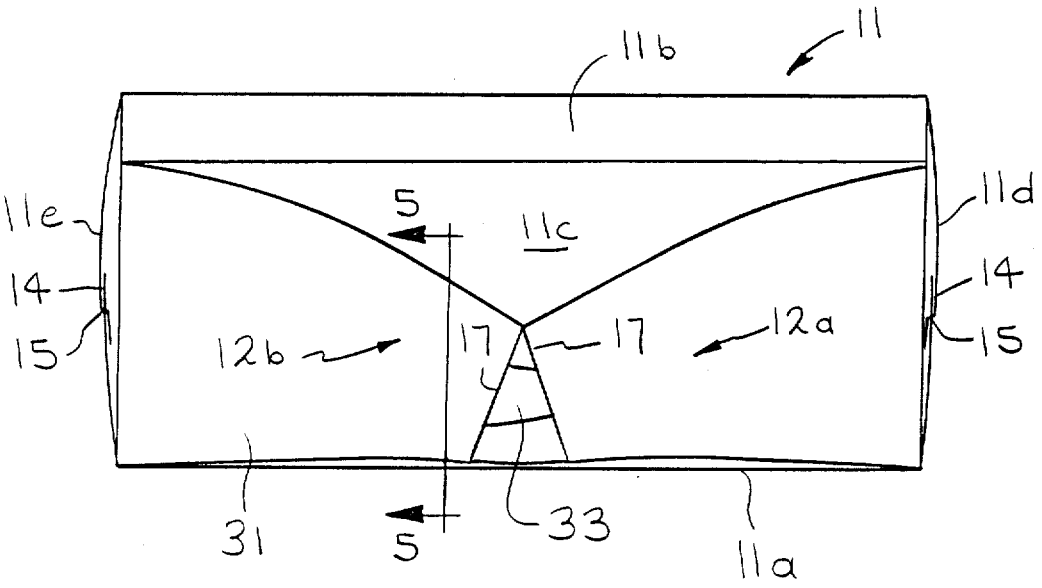
Figure 5:
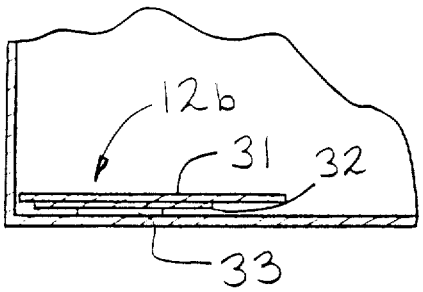
FIG. 5 is a partial cross-sectional view along line 5—5 of FIG. 4 showing the folded straps 12*b*.
Figure 6:
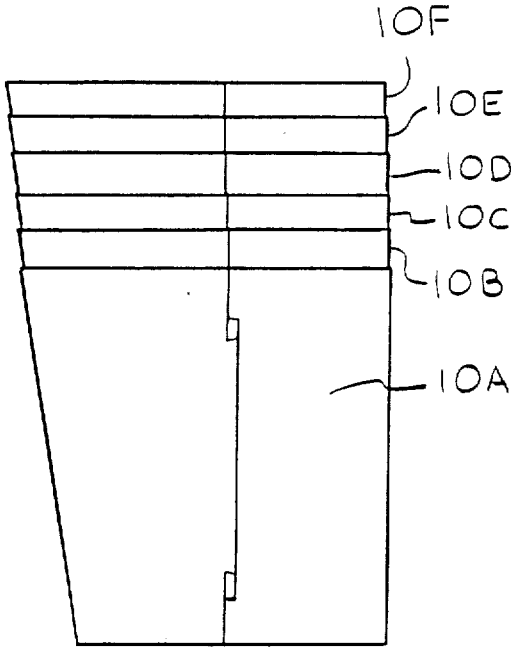
FIG. 6 is a side view illustrating the stacking of a group of devices, individually labelled items 10A–10F.

The device 10 is designed so that the straps 12*a* and 12*b* fold into the recess in the tray 11 as shown in FIGS. 4 and 5 with sections 31, 32 and 33. The crease lines 17 are shown in the straps 12*a* and 12*b*. As shown in FIG. 6, trays 10A to 10F can be nested together for shipment.

Thus as can be seen from FIG. 2, preform 20*a* for instance is removed from sheet 20 and folded along creases 21*a* to form the device 10. Tab 14 is interlocked with opening 15. Alternatively the device 10 can be assembled with glue, staples or the like used to secure the ends together at the factory (not shown) or molded as a unitary device. The device 10 is then ready for use or it can be stacked as shown in FIG. 6 with a group of devices individually labelled 10A–10F. The food (hamburger, french fries and the like can then be dispensed in the tray to the customers.

In use by the customer, the straps 12*a* and 12*b* are placed around the neck N of the person P and the tab 13 is interlocked with opening 16. When the use is completed the tab 13 and opening 16 are disconnected or the straps 12*a* and 12*b* could be torn.

As shown, the tray 11 is narrower in cross-section at the bottom 11*c* than at the opening into the tray 11 which is preferred for ease of stacking. Any cross-section can be used which provides a tray 11 with an adequate recess.

It is intended that the foregoing description be only illustrative of the present invention and numerous variations will occur to those skilled in the art and that the invention be limited only by the hereinafter appended claims.

I claim:

1. A protective device for collecting food spills to be positioned on a front body portion of a person in an upper chest area to catch the spills from the mouth of the person while seated in a moving vehicle which comprises:

(a) a rigid tray having a bottom, a front side away from the body portion, a back side adjacent to the upper chest area and opposite ends connecting the sides and the bottom to form the tray with a recess inside the tray for catching spills; and (b) a strap means provided on the tray as side extensions from the bottom which extend to and fasten around the neck of the person, wherein in use food falls from the mouth by gravity into the recess in the tray while the person is seated in the moving vehicle.

2. The device of claim 1 wherein the strap means are integral with the tray and wherein the strap means have attachment means which fasten around the neck of the person for securing the device to and unsecuring the tray from the neck of the person.

3. The device of claim 2 wherein the tray and strap means are cut from a single sheet of material as a preform, with two strap means at opposite ends of the bottom, wherein the strap means fold up from bottom and wherein each of the ends are provided in two parts with a tab on one part and an opening on the other part such that the tab and opening interlock to form the side with the strap means projecting from the recess in the tray along the sides.

4. The device of claim 3 wherein an end of a first strap means adjacent the back of the neck of the person is provided with a tab and an end of a second of the strap means adjacent the back of the neck is provided with an opening which receives the tab on the first strap means to thereby support the device on the person.

5. The device of claim 1 wherein the tray has a rectangular cross-section between the ends and wherein the sides are significantly longer than the ends.

6. The device of claim 5 wherein the tray has a ratio of length of the sides to width of the ends between the sides of between about 3 to 1 and 5 to 1 and wherein the width of the ends is at least about 5 centimeters.

7. The device of claim 1 composed of a disposable material.

8. The device of claim 1 wherein multiple of the devices have been provided on a perforated precut sheet of material as a preform and wherein the preforms are removed and assembled to form the device.

9. The device of claim 1 wherein multiple of the devices are stacked one on top of each other with each of the strap means folded in the recess of each tray.

10. A method for collecting food spills while seated in a moving vehicle which comprises:

(a) providing a protective device to be positioned on a front body portion of a person in an upper chest area which comprises a rigid tray having a bottom, a front side away from the body portion, a back side adjacent the upper chest area and opposite ends connecting the sides and the bottom to form the tray with a recess inside the tray for catching the spills; and a strap means provided on the tray as side extensions which extend to an from the bottom and fasten around the neck of the person, wherein in use food falls by gravity from the mouth into the tray while the person is seated in the moving vehicle;

(b) mounting the device around the neck using the straps means;

(c) collecting the food spills in the recess in the tray; and (d) removing the strap means from around the neck after use.

11. A sheet of material containing multiple precut preforms which can be removed and assembled to form a protective device for collecting food spills to be positioned on a front body portion of a person on an upper chest area to catch the spills from the mouth of the person while seated in a moving vehicle which comprises: a rigid tray having a bottom, a front side away from the body portion, a back side adjacent to the upper chest area and opposite ends connecting the sides and the bottom to form the tray with a recess; and strap means provided on the tray as side extensions which extend to an from the bottom and fasten around the neck of the person, wherein in use food falls by gravity from the mouth into the tray while the person is seated in the moving vehicle, wherein the tray and strap means for each device are provided by the sheet of material.

12. The sheet of material of claim 11 wherein the ends of the tray are provided in two parts with a tab on one part and an opening on the other part such that the tab and opening interlock to form the side.

13. The sheet of claim 12 wherein there are two strap means one at each of the ends of the tray and wherein an end of a first of the strap means adjacent the back of the neck of the person is provided with a tab and an end of a second of the strap means is provided with an opening which receives the tab on the first strap means so as to support the device around the neck of the person.

14. The sheet of claim 11 wherein the strap means are adapted to be creased for folding into the tray so as to be overlapped prior to use of the device.

15. The method of claim 10 wherein the strap means are folded into the tray prior to use of the device.

* * * * *

UNITED STATES PATENT AND TRADEMARK OFFICE

CERTIFICATE OF CORRECTION

PATENT NO. : 4,887,315

DATED : December 19, 1989

INVENTOR(S) : William J. Bezdek

It is certified that error appears in the above—identified patent and that said Letters Patent is hereby corrected as shown below:

Column 3, line 25, after "against", the following should be inserted --an upper portion of the chest C about 1 to 6 inches (2.54--.

Column 3, line 46, after "device 10" insert a period --.--.

Column 3, line 57, after "Figure 2." the following sentence should be inserted --Preform opening 25 is provided for preform tab 24.--.

Column 5, line 26 (Claim 10) after "tray" delete "as side extensions" and insert therefor --as side extensions from the bottom--; and line 27, after "extend to" delete "an from the bottom".

Column 6, line 13, after "tray" delete "as side extensions" and insert therefor --as side extensions from the bottom--; and line 14, after "extend to" delete "an from the bottom".

Signed and Sealed this

Twenty-sixth Day of February, 1991

*Attest:*

HARRY F. MANBECK, JR.

*Attesting Officer*

*Commissioner of Patents and Trademarks*